United States Patent [19]

Christiansen

[11] 4,222,337

[45] Sep. 16, 1980

[54] FURNACE LINING AND METHOD OF MANUFACTURE

[75] Inventor: Jørgen B. Christiansen, Jystrup, Denmark

[73] Assignee: Isomax, Ingeniør- OG Handelsaktieselskab, Jystrup, Denmark

[21] Appl. No.: 895,712

[22] Filed: Apr. 12, 1978

[30] Foreign Application Priority Data

Apr. 14, 1977 [DK] Denmark ..... 1653/77
May 20, 1977 [DK] Denmark ..... 2207/77

[51] Int. Cl.[3] ..... F23M 5/00

[52] U.S. Cl. ..... 110/336; 29/407; 110/341; 228/140; 432/247

[58] Field of Search ..... 29/407, 423, 455, 526; 156/71; 110/336, 341; 432/247; 228/140

[56] References Cited

U.S. PATENT DOCUMENTS

| | | | |
|---|---|---|---|
| 3,892,396 | 7/1975 | Monaghan | 110/336 |
| 3,909,907 | 10/1975 | Davis | 110/341 |
| 3,930,913 | 1/1976 | Shelley | 110/341 |
| 3,993,237 | 11/1976 | Sauder et al. | 110/336 |
| 4,011,394 | 3/1977 | Shelley | 110/336 |
| 4,088,825 | 5/1978 | Carr | 110/336 |

*Primary Examiner*—Edward G. Favors
*Attorney, Agent, or Firm*—Edward F. Levy

[57] ABSTRACT

A furnace lining is composed of a plurality of layers of fiber insulation. The innermost layer is formed by stacking flat, elastically-compressible fibrous strips. The stacked strips are compressed and held down in compressed condition by a plurality of anchor members secured to and projecting perpendicularly from the furace wall and extending between selected strips of said innermost layer. The elastic compression applied to the strips creates a frictional grip between the strips and the anchor members, which maintains the lining in a stable mounted position. The lining may also include an intermediate layer between the innermost layer and the furnace wall, this intermediate layer being also formed of superimposed, strips stacked flat upon one another, with the intermediate layer frictionally anchored to the outermost layer.

14 Claims, 6 Drawing Figures

Fig. 1.
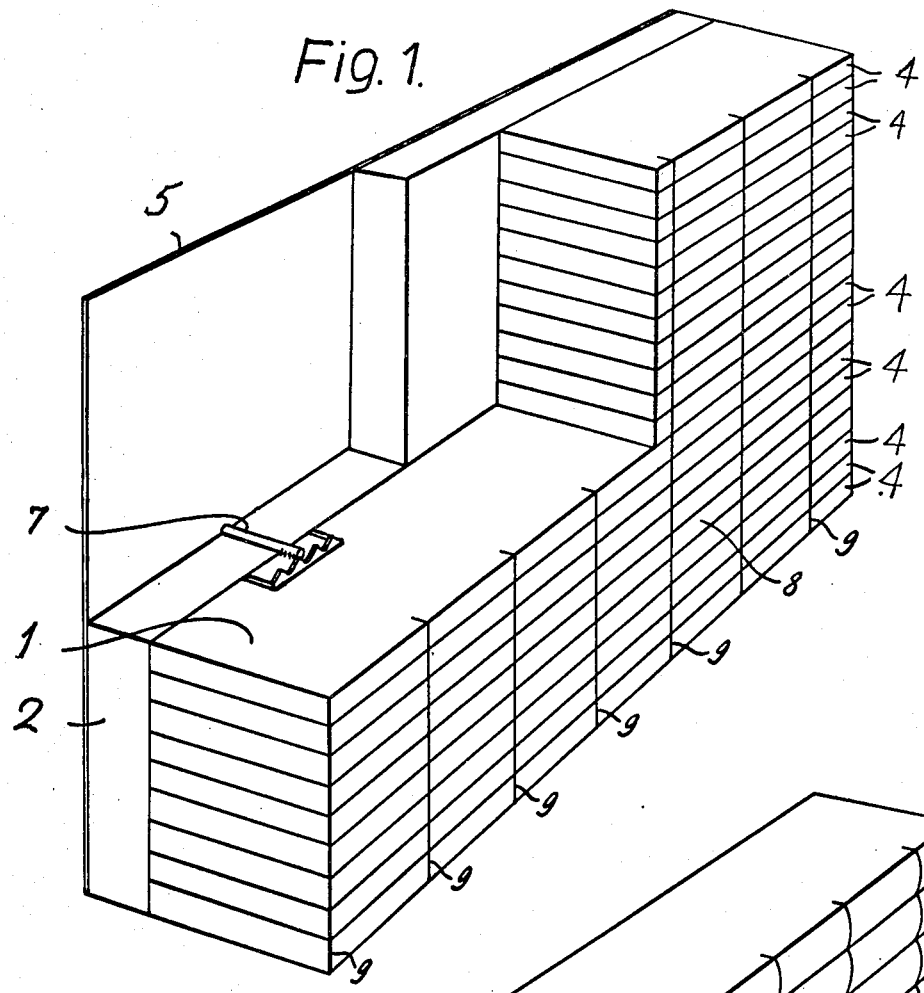
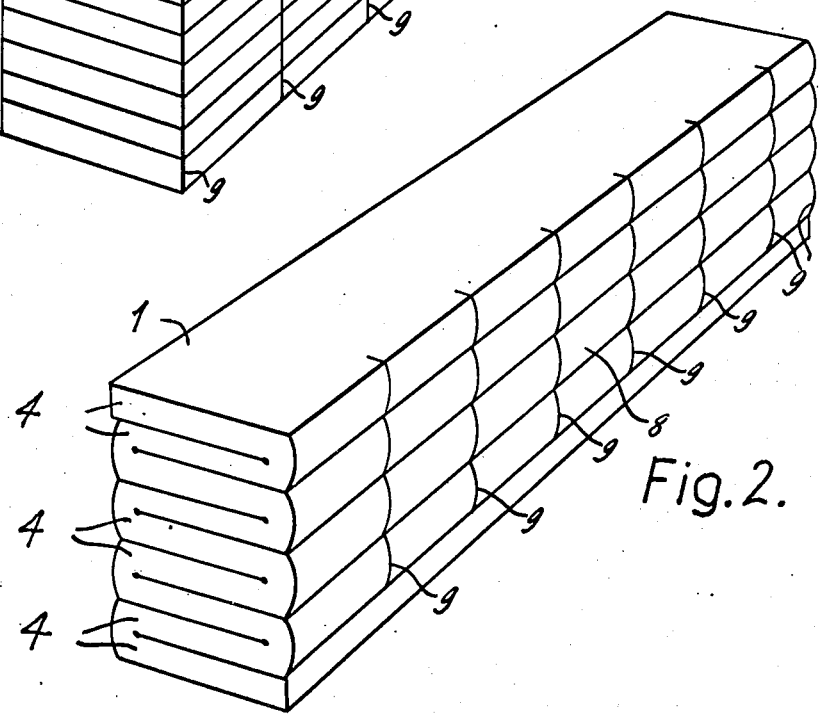
Fig. 2.

FURNACE LINING AND METHOD OF MANUFACTURE

This invention concerns a furnace lining consisting of one or more layers of fiber insulation in which at least the layer towards the furnace interior is made up of strips placed with the flat sides against one-another, and anchored to outer furnace shell by anchors placed mainly between the strips perpendicular to the furnace shell.

A furnace lining of this particular type is known from U.S. patents. U.S. Pat. Nos. 3,819,468 and 3,993,237 respectively, based upon the principle of piling the fiber insulation with edges outwards to reduce the devitrification of the fiber insulation caused by the fact that the fibers are oriented lengthwise parallel to the surface of the fiber insulation.

This known furnace lining is constructed of blocks consisting of two layers, a back-up of a sturdy and rigid mineral insulation to which a second layer of strips with the fibers oriented perpendicular to the back-up is fastened. To maintain the block form, the strips are held together by through-going threads, and the back-up and the layer of piled strips are fastened to each other for example by ceramic cement or mortar or by needles that loop around the threads in the strip layer. The block dimensions are small, 31 cm by 31 cm, and it is fastened to the furnace shell by means of an anchor placed in the middle of the block. To obtain completely tight insulation in the lining the blocks are manufactured with an overlength of 6 mm which is compressed during installation. The blocks are placed alternating 90 degrees by which the compression transversely to the strips compensates for the lengthwise shrinkage of the strips adjacing perpendicularly.

It is desirable for economic reasons to vary the quality of the fiber insulation in relation to the temperature gradient through the lining as the ceramic fiber materials necessary at elevated temperatures are considerably more expensive than fiber materials as mineral wool and fiberglass which generally can be used up to 600° C. only. It is difficult or even impossible to make such a variation of the fiber quality according to the furnace linings known.

These known fiber linings are also lacking ease in their anchoring to the furnace shell. In some cases, as in the above-mentioned U.S. patent the anchor lies buried in the fiber insulation during fastening and hence it is not even visible. In another case a special fixture is needed.

The purpose of this invention is to specify a furnace lining which is simple, easier, and faster to manufacture than the methods known hitherto.

According to the invention this is achieved by applying an elastic compression in the planes of the furnace wall, sufficiently enough that the power of friction between the strips reciprocally, and between the strips and the anchors is sufficient to provide a fiber layer which is stable also during service conditions. The elastic compression of the strips can be applied both transversely to the flat side of the strips as well as lengthwise. By application of the elastic compression the coefficient of friction between two sides of a fiber insulation can be of considerable size due to the infiltration of the fibers into one-another along the contact surface. Hence the compression causes the power of coadhesion of the strips to be increased applying this power perpendicular to the contact surfaces of the strips, and the power of friction is just increased by the perpendicular power to the friction surface, in this case the above-mentioned surfaces. The power of coadhesion along the contact surface, as stated, enables one to combine fiber strips to a coadheasive stable unit without using an adhesive component or other means.

The fact that a layer of lining is made up of strips placed with the sides upon one-another can be obtained in two ways, namely by repeated folding of a mat or sheet insulation or, in its simplest form, by strips.

The fiber insulation can be devitrified as mentioned in Norwegian Pat. No. 130 704 by shrinkage and surface reactions which result in delamination or peeling off from the surface of the fiber material due to the laminated composition of the fiber material which is caused by its method of production. This cracking and peeling off can, as mentioned in the Norwegian patent, be avoided by cutting the fiber blanket into strips transversely to the longitudinal direction of the blanket, but it can as well be avoided by cutting strips along the longitudinal direction of the blanket. There is nothing to prevent, therefore, the use of strips which are cut in the longitudinal direction of the blanket. So one is not limited to the width of the fiber blanket which is fairly small, say one meter, but one can obtain strips at the same length as the furnace wall. Another advantage is that these strips easily can be cut and supplied directly from the blanket machine.

In cases where the furnace lining consists of more than one layer of strips, and in cases where these layers preferably are adjacent to each other without other intermediate layers the furnace lining is in particular appropriately built so that the applied elastic compression is higher in the primary layer, and decreasing through the succeeding layers, by which one achieves that the elastic compression in the layers of strips after the furnace has been put into service becomes uniform—although preferably higher in the primary layer—as a result of the fact that the fiber insulation material changes, decreasing from hot face.

If a fiber material does not have sufficient mechanical strength this can appropriately be improved so that a non-elastic compression is applied to the layers besides the elastic one.

The insulation is preferably exposed to elastic compression perpendicular to the flat side of the strips which is advantageous by the fact that one works from above downwards and hence at a perpendicular lining.

In order to lock the ends of the lining at transversed walls, burner blocks or corners the strips are exposed to an elastic compression in their longitudinal direction so that they are locked between these members. The locking effect can furthermore be achieved by securing a strip of fiber insulation along transversed walls, burner blocks, corners etc. in such a way that the ends of the adjacent strips by friction are locked to this secured strip. The compression of the strips lengthwise can be achieved by the fact that the strips during installation form a slight curve upwards, and the ends are kept in place by friction to the layer of strips underneath. When the curve is pressed down a lengthwise compression is applied to the strip.

In cases where the furnace lining is built from more layers of strips it is advantageous that two or more of these are interconnected by anchors so that these layers work as a mechanical unit, and increase the stability of the lining as to the columnar effect.

At the anchoring of the lining one makes use of the elastic compression applied to the fiber lining, as a compression causes the insulation to be squeezed around the anchors. The anchoring can be made in two fundamentally different ways, either by friction between the fiber insulation and the anchors or by using the drawing and displacement strength of the insulation. The use of friction for the anchoring is a particularly easy method as the anchors simply are laid between the strips, and the anchor power then follows by the elastic compression of the fiber insulation.

These anchors of friction can, for example, be made of expanded metal or a steel plate with bent edges. At the interconnecting anchoring of a number of strip layers adjacent to each other, the anchoring is particularly simple by the fact that a number of fiber strips in one or more of the layers have such a width that they stretch unbroken into or through one or more of the fiber layers by which staggered joints are achieved between the fiber strips. Likewise, at the anchors of friction the inter-related influences between fiber layers are transferred by the power of friction caused by the elastic compression applied. The anchoring can be made also by means of anchors that penetrate into the fiber material so to make use of the drawing and displacement strength of the fiber materials. The parts of the anchors that penetrate into the insulation are manufactured to a length that preferably is shorter than the thickness of the strips. Particularly appropriately the anchors can be made with triangular or square teeth to be pressed into the fiber insulation achieving an alternation between undisturbed fibers and anchor surfaces by which the anchoring power is spread over a large area, but in such a way that it at the same time does not cut the fibers over a long distance.

Above a certain temperature, fiber materials will start to change towards brittleness, hardness, shrinkage, and devitrification, and the degree of these changes will increase the closer it comes to its nominal service temperature, which in turn also causes the elastic characteristics of the fiber material to decrease to a varying degree. As to the physical characteristics the lining will be divided into two zones, a zone next to the heat in which changes will occur, and in which the insulation will lose its elastic characteristics to a higher or lower degree depending on the temperature, and into a zone farthest away from hot face in which the physical characteristics to a large degree will be unchanged, and hence the elastic compression which is applied to the fiber material, during its installation will continuously also be present during service conditions.

It is exactly in this zone that the anchors are placed, and they are preferably placed at temperature levels at 800–1000° C. or below. This means that the anchoring power is of approximately the same size at service conditions as during installation as the fiber insulation since the anchoring zone still maintains the elastic compression that squeezes the fiber insulation into close contact with the anchors. Besides, the anchors are not exposed to the high temperature and hot face, and the anchors themselves are protected from deterioration by possible agressive furnace atmospheres. At temperatures above 800–1000° C. in the first strip layer one can make use of the stagger-joint procedure as discussed earlier.

In order to reduce the costs of the furnace lining one can, as discussed earlier, make use of more fiber material qualities adjusted to the temperature gradient through the lining. These succeeding layers of fiber insulation can be installed by known procedures, for example, they can be piled on edges, put up as lengths or poured between the strip layer and the shell as loose material. These layers, whether they are installed according to the procedures in this invention or by means of methods known, does not necessarily need anchoring as the primary layer—the layer next to the furnace interior—due to the width of the strips will absorb a modulus of rupture between anchors transversely to the lining, and hence it will keep these layers in place.

In order that the shrinkage cracks developed in the hot face should not be regarded as unesthetic or cause unjustified distrust in the lining these cracks can be spread evenly along the lining by cutting preferably parallel running tracks in hot face transversely to the strips. The depth of these tracks and their distance is decided according to the experience in deep shrinkage cracks normally will develop at a given temperature and material.

In order to fit, the fiber material applied for the system must possess a certain compression strength, elasticity and reversable springaction. Should these characteristics prove to be insufficent they can be improved by impregnating the fiber insulation with an organic, inorganic chemical bond or a ceramic sintering component material.

In the drawings:

FIG. 1 is a perspective view showing a portion of a furnace lining made in accordance with the invention and composed of two layers, with portions cut away to reveal the anchoring of the lining to the furnace wall;

FIG. 2 is a perspective view of a lining layer produced by folding a sheet of fibrous material.

Figure 3:
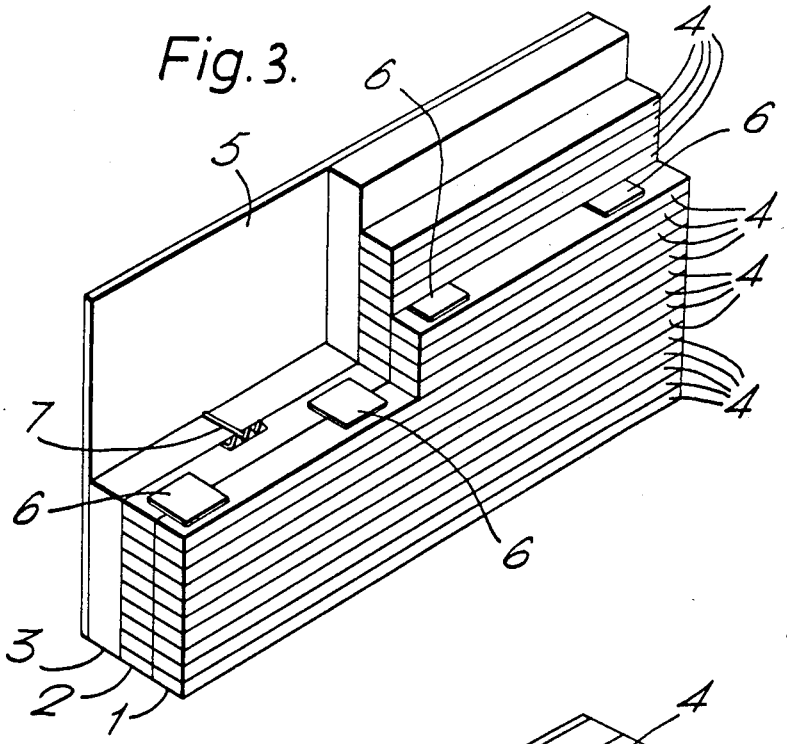
FIGS. 3 to 6 are perspective views similar to FIG. 1 and showing alternative embodiments of furnace linings made according to the invention.

Inwards to a furnace interior a layer of fiber 1 is built by strips 4 layed with the flat side upon one-another. The strips 4 are cut from fiber sheets or fiber lengths, or they can be specially produced for the purpose. It is fairly simple to cut the fiber lengths into strips during manufacture. The strips 4 can also, as shown in FIG. 2, be produced by repeated folding in corrugation formation of a sheet or length of material. This fiber layer 1 is succeeded by another fiber layer 2, which is adjacent to the furnace shell 5, and this fiber layer 2 is sheets piled on edges. This primary fiber layer 1 is at the rear side fastened to the furnace shell 5 by means of, over the entire lining evenly spread, anchors 7 which consists of a plate with triangular teeth, and which are fastened to the shell 5 by means of a piece of round bar iron. In the hot face 8 of primary fiber material 1 a number of parallel running tracks 9 are formed for controlled location of developing shrinkage cracks.

In FIG. 3 a furnace lining is shown built of three fiber layers 1,2,3 of which a primary layer 1, and a succeeding secondary layer 2 is made up of strips 4 piled with the flat side to one another. The tertiary fiber layer 3 is fiber sheets which are piled on edges between the interlocked primary and secondary layers 1,2 and the furnace shell 5. The primary and secondary layers 1,2 are anchored to one another by means of a friction material, 6 for example, pieces of expanded metal which are placed between the strips, and which stretch unbroken from the primary layer 1 into the secondary layer 2. Tne necessary power of friction for the mutual inter-anchoring is produced by the elastic compression.

The friction material 6 is spaced such that the primary layer 1 and the secondary layer 2 will form a stable unit. The anchoring of this stable unit to the furnace shell is made by the anchors 7 which are fastened in the secondary layer 2.

Figure 4:
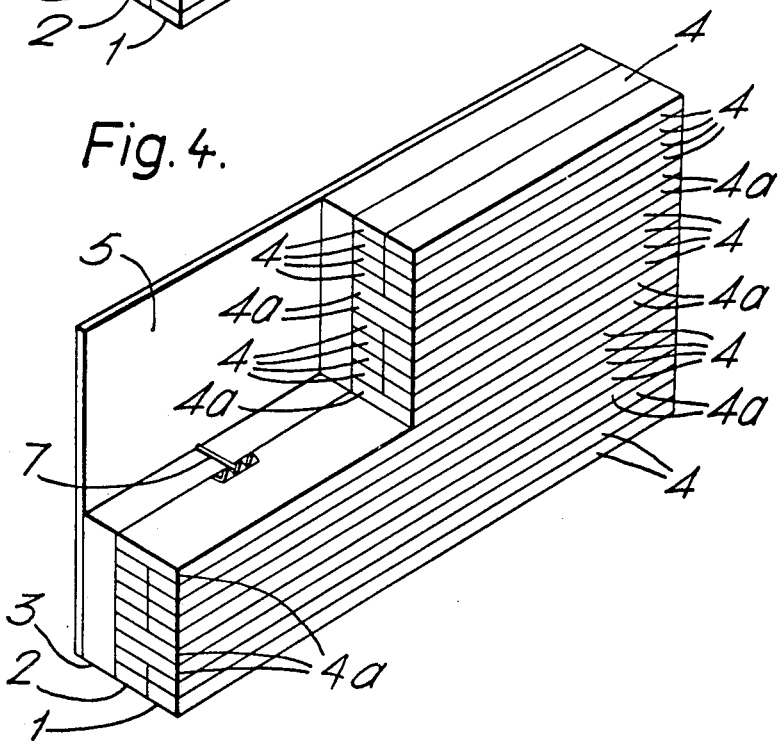

In FIG. 4 an embodiment of the furnace lining is shown in which the inter-anchoring of primary layer 1 and secondary layer 2 to one another to obtain the formation of a stable unit is obtained by placing—at certain intervals—fiber strips 4*a* of the fiber material used for primary layer 1 of a width corresponding to the added width of primary layer 1 and secondary layer 2. Hence the inter-related influences between the two layers 1,2 are transferred by the strips 4*a* by means of the power of friction produced by the elastic compression. In this specific case two abutting fiber strips 4*a* are used, and the anchoring 7 is placed between these two strips 4*a*.

Figure 5:
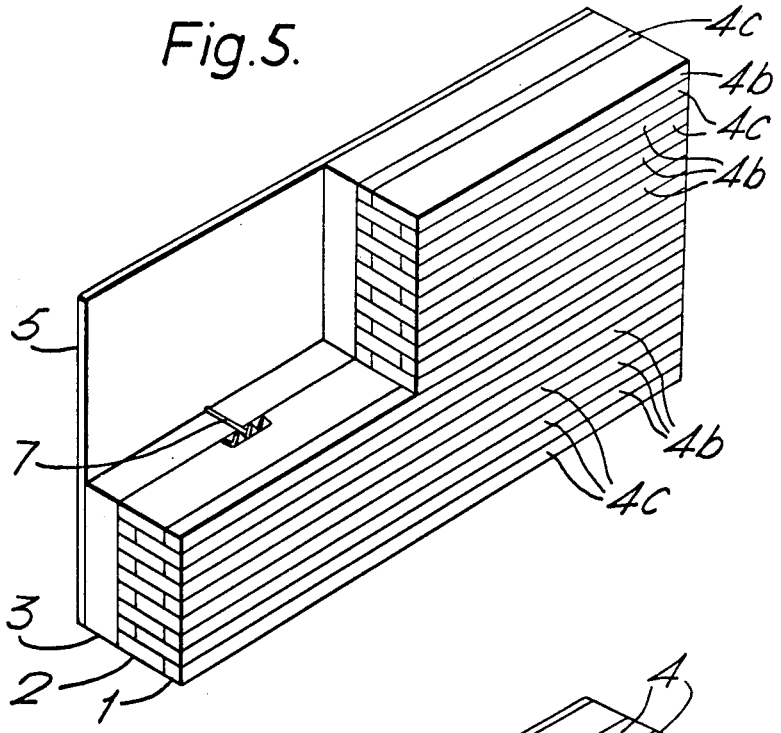

As seen from FIG. 5 the inter-anchoring between primary layer 1 and secondary layer 2 is produced by the fact that these layers are built of fiber strips of varying width so to achieve staggered joints in which primary layer 1 and secondary layer 2 reciprocally catch into one another, and the inter-related influence is transferred by the power of friction previously mentioned.

Figure 6:
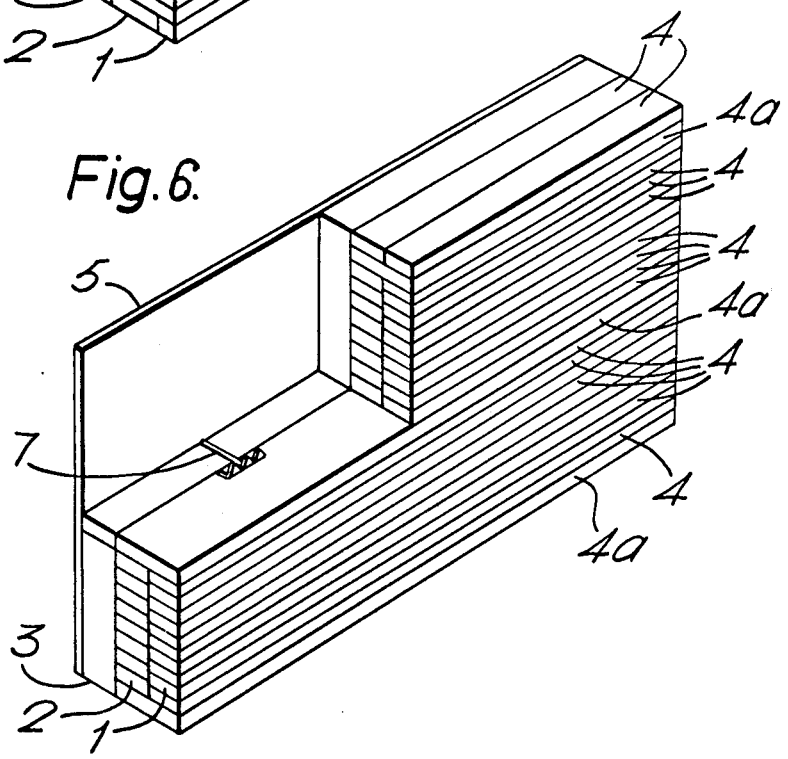

FIG. 6 shows a lining in which is used ten strips in primary layer 1 for every eight layers of strips in secondary layer 2, both of the same thickness and density, so that a larger elastic compression is applied to the primary layer, and so that a uniform compression is obtained in both layers 1,2 after the furnace has been put into service resulting from the fact that the fiber materials in the primary layer 1 undergo more changes than the secondary layer 2, although preferably so that the compression in the primary layer 1 is larger than that in the secondary layer 2.

As will be seen from above description the invention resides in the use of individual or combined physical characteristics of a fiber material other than the heat insulation effect and refractorines when building a furnace lining from the fiber material.

At its application the fiber material is given an elastic compression which in combination with its large coefficient of friction results in a large inter-adhesion and stability, and the compression at the same time squeezes the material elastically around the anchoring. 9n

I claim:

1. a method of lining the interior surface of a furnace wall with a lining of one or more layers of fiber insulation, including a primary layer adjacent to and exposed to the interior of said furnace, said method comprising the steps of stacking a plurality of flat, elastically compressible fibrous strips in a row parallel to said furnace wall with the flat faces of said strips making flush abutment with each other and extending in planes transverse to the plane of said furnace wall, applying elastic compression to groups of said strips in said row in a direction to decrease the height of each of said groups, providing a plurality of elongated linear anchor members each having at one end a flat face having a width substantially less than the width of said strips, placing upon the uppermost strip of each of said groups of stacked, compressed strips the flat faces of at least one of said anchor members, and securing the other end of each anchor member to said furnace wall, the elastic compression applied to said strips being sufficient to create a frictional grip between adjacent fibrous strips and between said strips and said anchor members, whereby to maintain said lining in a stable mounted position during servicing conditions.

2. A method according to claim 1 which includes the steps of forming said lining of a plurality of adjacent layers of stacked fibrous strips and applying compression with greatest force in the primary layer and with progressively decreasing force in the layers approaching said furnace wall.

3. A method according to claim 1 which includes the step of applying to at least said primary layer of said lining a non-elastic compression in addition to said elastic compression.

4. A method according to claim 1 in which said elastic compression is applied in a direction parallel to said furnace wall.

5. A method according to claim 3 in which said non-elastic compression is applied in a direction lengthwise of said strips.

6. A method according to any one of claims 2 to 5 which includes the steps of attaching fiber strips to the interior surfaces of said furnace which confront the ends of said stacked strips, and pressing the ends of said stacked strips into frictional engagement with said attached fiber strips, whereby to lock the ends of said lining layers to said furnace.

7. A method according to claim 1 or 5 which includes the additional step of frictionally anchoring together at least two of said adjacent layers of stacked fibrous strips.

8. A furnace lining assembly comprising a furnace lining made of fibrous ceramic material, and means for anchoring said lining to the inner wall surface of said furnace, said furnace lining including at least one layer formed of a plurality of flat, elastically-compressible fibrous strips stacked upon each other with their flat faces in flush abutment and with said layer under compression, said anchoring means comprising a plurality of elongated, linear members secured to said inner wall surface of said furnace and projecting perpendicularly therefrom, each of said anchor members having a flat free end portion overlying a selected strip of said compressed layer and frictionally gripping the latter, said anchor members being positioned to maintain the underlying strips in said layer under elastic compression sufficiently to create a frictional grip between adjacent fibrous strips and between said strips and anchor members, whereby to maintain said lining in a stable mounted position during servicing conditions.

9. A furnace lining assembly according to claim 8 in which said layer has a hot face facing the interior of said furnace, in which the flat free end portions of said anchor members are sized to grip said strips at points spaced inwardly from said hot face, said layer being formed with a plurality of spaced, parallel tracks in the hot face thereof, said tracks extending transversely to the plane of said strips.

10. A furnace lining assembly according to claim 8 in which said furnace lining comprises a plurality of layers each composed of stacked fibrous strips and arranged in side-by-side relationship, and means frictionally connecting said layers to each other as a stable unit, the free end portion of said anchor members engaging and gripping the strips of one of said layers other than the outermost layer.

11. A furnace lining assembly according to claim 8 in which at least some of said anchor members are positioned such that their free end portions extend between adjacent strips in said layer, said free end portions having a length shorter than the width of said strips.

12. A furnace lining according to claim 11 in which the free end portions of said anchor members are formed with spaced protruding teeth which are pressed into the fibrous body of the strips engaged by said anchor members.

13. A furnace lining according to claim 8 in which said furnace lining includes a plurality of layers of stacked fibrous strips arranged in side-by-side relationship, selected strips of said layers having a width equal to the combined width of said layers and extending through said layers, whereby to anchor said layers to each other.

14. A furnace lining according to claim 10 in which said layers are frictionally connected to each other by thin sheets of friction material overlying and connecting aligned strips of said layers.

* * * * *